United States Patent [19]

Hsu

[11] Patent Number: 5,076,583

[45] Date of Patent: Dec. 31, 1991

[54] RACKET FRAME WITH CIRCULAR CROSS SECTION AND VARIABLE THICKNESS

[75] Inventor: Henry Hsu, Taichung, Taiwan

[73] Assignee: Sportstech Industries (U.S. Tech) Inc., Redmond, Wash.

[21] Appl. No.: 569,391

[22] Filed: Aug. 21, 1990

[51] Int. Cl.[5] ..... A63B 49/02

[52] U.S. Cl. ..... 273/73 C

[58] Field of Search ..... 273/73 R, 73 C, 73 F, 273/73 G, 73 J, 67 R, 67 DA

[56] References Cited

U.S. PATENT DOCUMENTS

| | | | |
|---|---|---|---|
| 1,470,878 | 10/1923 | Robinson . | |
| 2,540,728 | 11/1970 | Palmer | 273/73 C |
| 3,431,626 | 3/1969 | Carlton | 273/73 HX |
| 3,556,524 | 1/1971 | Carlton | 273/73 |
| 3,568,290 | 3/1971 | Carlton | 29/163.5 |
| 3,809,402 | 5/1974 | Haines et al. | 273/73 |
| 4,046,377 | 9/1977 | Khazzan | 273/73 |
| 4,690,405 | 9/1987 | Frolow | 273/73 |
| 4,919,438 | 4/1990 | Yoneeyama | 273/73 C |
| 4,997,186 | 3/1991 | Carr | 273/73 C |

FOREIGN PATENT DOCUMENTS

| | | | |
|---|---|---|---|
| 122823 | 11/1946 | Australia . | |
| 798744 | 11/1968 | Canada . | |
| 61721 | 10/1937 | Norway . | |
| 475011 | 8/1969 | Switzerland . | |
| 2205 | 1/1911 | United Kingdom | 273/73 G |
| 1266531 | 3/1972 | United Kingdom . | |
| 14247 | 10/1984 | United Kingdom . | |
| 2179263 | 3/1987 | United Kingdom . | |

*Primary Examiner*—William H. Grieb

*Attorney, Agent, or Firm*—Christensen, O'Connor, Johnson & Kindness

[57] ABSTRACT

A game racket (11) having improved aerodynamics and hitting response is disclosed. With the exception of the handle (13) the entire racket is comprised of elements all having a substantially circular cross section. The head (17) of the racket (11) is comprised of three sections. Each section may have a different cross sectional diameter.

15 Claims, 3 Drawing Sheets

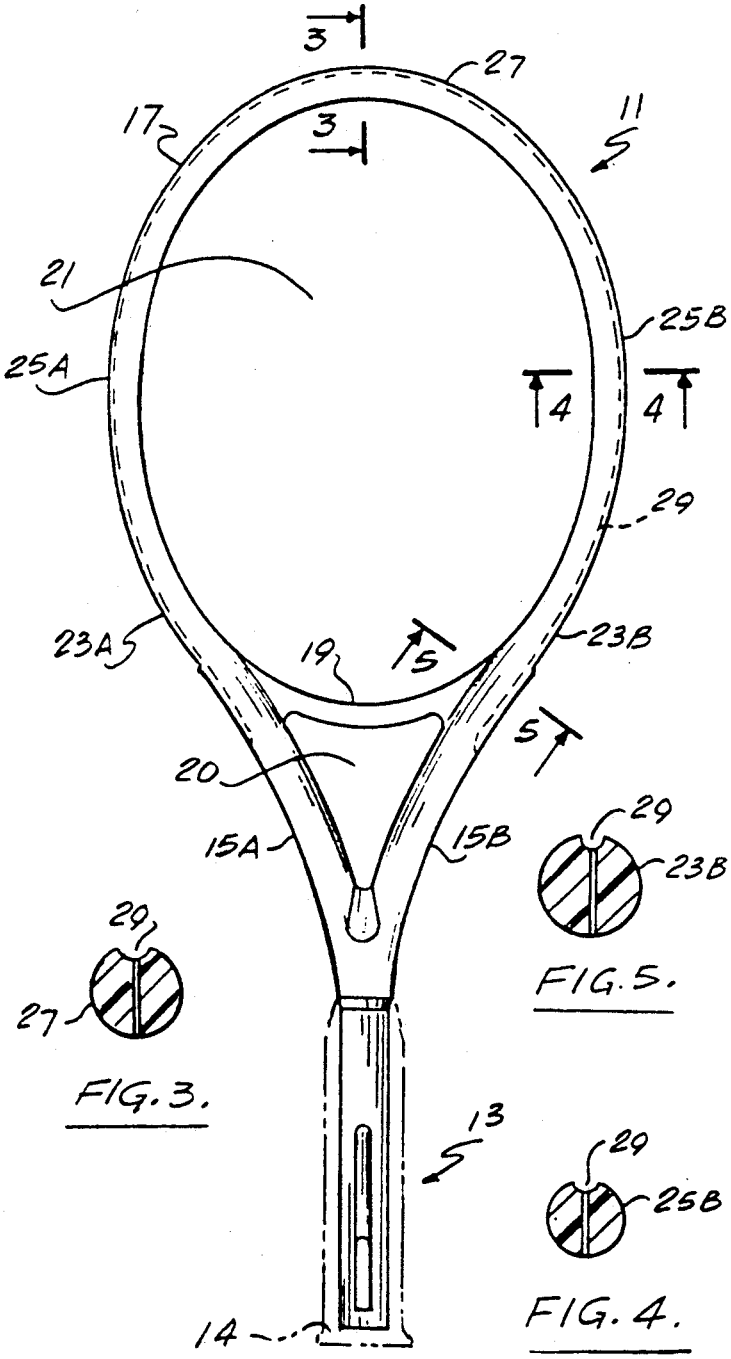
FIG. 1.
FIG. 3.
FIG. 5.
FIG. 4.
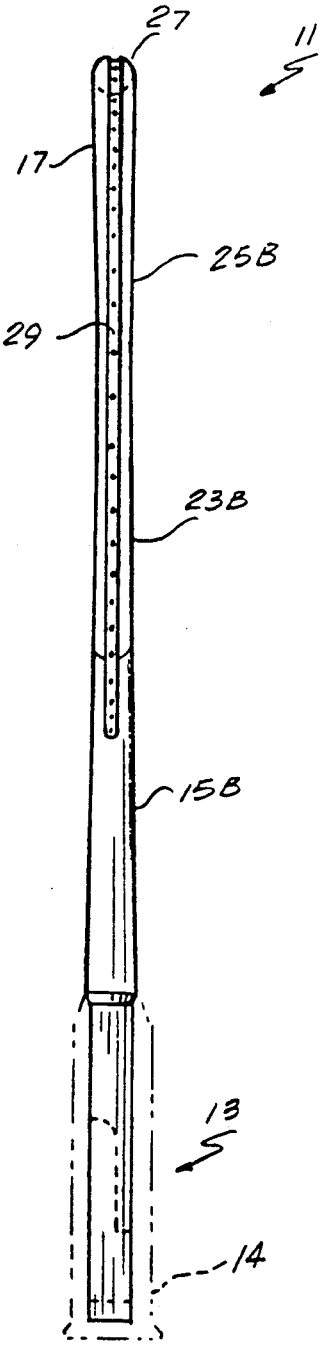
FIG. 2.

RACKET FRAME WITH CIRCULAR CROSS SECTION AND VARIABLE THICKNESS

TECHNICAL AREA

The invention is directed to game rackets and, more particularly, to a tennis racket frame having an aerodynamic profile and variable frame thickness.

BACKGROUND OF THE INVENTION

The popularity of racket sports has continuously increased over the past 10–20 years. Concomitant with this increase in popularity are the technological advances in the sports equipment. In particular, the art of design and manufacture of racket frames has developed in an effort to improve racket performance. As an example, with respect to tennis rackets, the racket frames have evolved from the use of wood as the predominant material of choice, to the steel-shafted rackets of the early 1970s, to the graphite and ceramic composites of today.

One of the most recent trends in racket design is the use of the so-called "wide body" rackets as exemplified by U.S. Pat. No. 4,664,380. This racket type has a thickness, as measured orthogonal to the stringing plane, which is larger in the throat portion, relative to the prior art. Further, the racket frame thickness tapers continuously from the throat portion to the top of the head and also tapers continuously from the throat portion to the handle. Additional "wide body" rackets of the prior art are manufactured by Prince® Mfg. This family of rackets has a constant taper, whereby the racket frame thickness progressively becomes thicker from the handle to the top of the head. The constant taper system of the Prince® racket allows for greater stiffness in the top of the head portion.

Although the overall performance of these rackets may be improved relative to other prior art, a large segment of tennis players may find these rackets unsuitable. For example, one of the important parameters of a tennis racket is the stiffness of the racket. The stiffness of a racket is defined to be the amount of racket frame resistance to a force applied orthogonal to the stringing plane. Generally, the stiffer the racket the more vibration at impact is transmitted to the tennis player. Although this vibration can be a major cause of many arm injuries, most tennis players require some measure of stiffness, because stiffness in the racket gives the player more control and accuracy and less "trampolining" effect. However, the two examples of "wide body" rackets described above may be overly stiff for many players because of the substantial thickness of the rackets, thus increasing the possibility of injury.

Moreover, another major disadvantage of the prior art is that because of the thickness of the frames, increased air resistance may be encountered during use of the tennis racket. Although air resistance with these prior art rackets may be relatively low when the racket is swung in a direction orthogonal to the stringing plane, if the racket is swung in any other direction, air resistance increases dramatically. This is because the cross-sectional profile of the frames described above can best be described as an elongated oval. Thus, the frames have a small aerodynamic profile when viewed orthogonal to the stringing plane and a much larger aerodynamic profile when viewed parallel to the stringing plane. Further, it can be appreciated that in most tennis strokes the racket does not travel directly orthogonal to the string plane, but rather in a "low-to-high" aerodynamic profile motion, thus exposing the thickest racket profile to the air when the racket is traveling at its maximum speed. In some strokes, such as the serve, the direction of racket travel may be nearly parallel to the stringing plane, once again exposing the largest racket profile to the air.

In contrast, the present invention incorporates the advantages of "wide body" rackets without the problems of excessive racket stiffness or excessive aerodynamic drag of the prior art rackets. Specifically, a lightweight tennis racket having a frame of adequate stiffness and a circular cross section is disclosed.

SUMMARY OF THE INVENTION

In accordance with the present invention, a racket frame having improved aerodynamics and optimum stiffness characteristics is disclosed. The racket frame comprises an elongated handle portion, a left and right throat portions of arcuate shape having a substantially circular cross section, an arcuate bridge portion having substantially circular cross section, and an arcuate head portion having a substantially circular cross section of variable diameter. The left and right throat portions are attached to the handle portion and extend longitudinally and curving laterally away therefrom. The arcuate bridge portion extends transversely to the length of the handle and intersects the ends of the left and right throat portions. The head portion cooperates with the bridge portion to form a closed a curvilinear shape.

In one specific embodiment of the present invention, the head portion is comprised of a top crown section, a middle section, and a lower section. The top crown section has a circular cross section diameter larger than the circular cross section diameter of the middle section. Further, the lower section has a circular cross section diameter approximately equal to the circular cross section diameter of the top crown portion.

In another specific embodiment of the present invention, the head portion has a circular cross section diameter which is substantially constant throughout and substantially equal to the circular cross section of the throat portions.

In a further specific embodiment of the present invention, the head portion is comprised of a top crown section, a middle section, and a lower section. The top crown section has a circular cross section diameter larger than the circular cross section diameter of the middle section. Further, the middle section has a circular cross section diameter which is larger than the circular cross section diameter of the lower section. Finally, the lower section has a circular cross section diameter greater than the circular cross section diameter of the throat portions. Thus, the circular cross section diameter of the racket progressively decreases from the top crown section to the throat portions.

In an additional specific embodiment of the present invention, the head portion is comprised of a top crown section, a middle section, and a lower section. The top crown section has a circular cross section diameter less than the circular cross section diameter of the middle section. Further, the lower section has a circular cross section diameter approximately equal to the circular cross section diameter of the top crown portion. Thus, the circular cross section of the racket is smaller at the top crown section, larger in the middle section, and smaller at the lower section and throat portions.

BRIEF DESCRIPTION OF THE DRAWINGS

FIG. 1 is a plan view of a tennis racket constructed in accordance with the present invention;

FIG. 2 is a side view of the racket of FIG. 1;

FIGS. 3, 4 and 5 are cross-sectional views of the tennis racket of FIG. 1 taken substantially along lines 3—3, 4—4 and 5—5 respectively thereof;

DESCRIPTION OF THE PREFERRED EMBODIMENT

Figure 6:
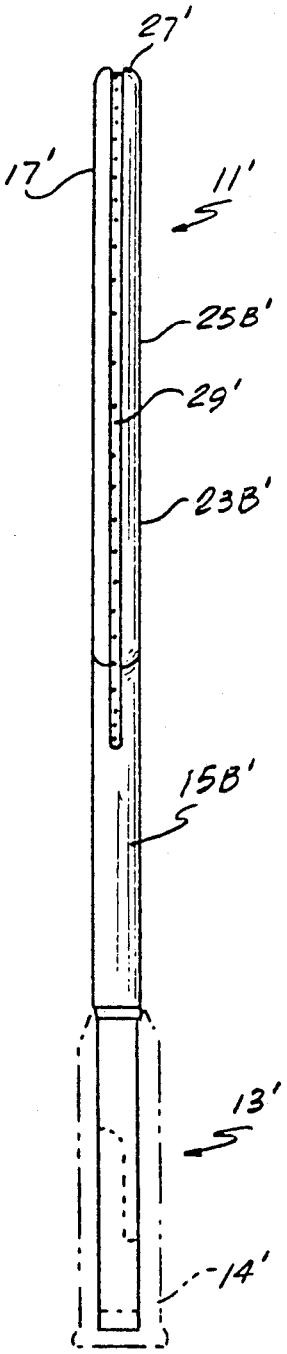
FIGS. 6 and 7 are side views of additional preferred embodiments of a tennis racket formed in accordance with the present invention illustrating various racket profiles; and, FIGS. 8, 9 and 10 are fragmentary plan views of the present invention illustrating alternative preferred bridge constructions.

Although the description given below is primarily for a tennis racket frame 11, it can be appreciated that the general design concepts for the frame described herein may be for a racket frame for use in any racket sport. Referring first to FIG. 1, the tennis racket frame 11 includes a handle portion 13, throat portions 15A and 15B, a head portion 17, and a bridge 19.

The handle portion 13 is a substantially cylindrical member preferably composed of a plastic-type material or other lightweight, high-strength material. The interior of the handle preferably is hollow and is filled with a foamed plastic material which provides dampening of vibrations. Further, the handle is wrapped in a grip material 14, preferably leather, which facilitates sure grasp by the racket user.

Attached to one end of the handle 13 are curved throat portions 15A and 15B. The left throat portion 15A and the right throat portion 15B are elongated, arcuate segments that flair outwardly to tangentially intersect with the head portion 17. The throat portions are composed of resin-impregnated graphite fibers or other fibers of high strength and low weight. The segments are preferably hollow and have a cross-sectional shape which is substantially circular when taken in the plane orthogonal to the longitudinal axis of the segments. In one preferred embodiment, the throat portions 15A and 15B have a cross-sectional diameter of about 15 to 27 millimeters and ideally about 21.8 millimeters. The throat portions 15A and 15B as attached to the handle 13 extend outwardly and symmetrically from the end of the handle 13 to form a "Y" shape. Further, the throat portions and the handle 13 are oriented such that they are coplanar.

The bridge 19 is illustrated as in the form of an arcuate segment preferably composed of resin-impregnated graphite fibers or other high-strength, low weight material. The bridge 19 is preferably hollow and has a circular or substantially circular cross section. In one preferred embodiment, the circular cross section of the bridge has a diameter of about 8 to 19 millimeters and ideally of about 13.4 millimeters. The bridge 19 is positioned substantially transverse to the handle 13 and is disposed such that the ends of bridge 19 tangentially intersect with the distal ends of the right throat portion 15B and the left throat portion 15A to define a generally triangular open area 20.

Figure 8:
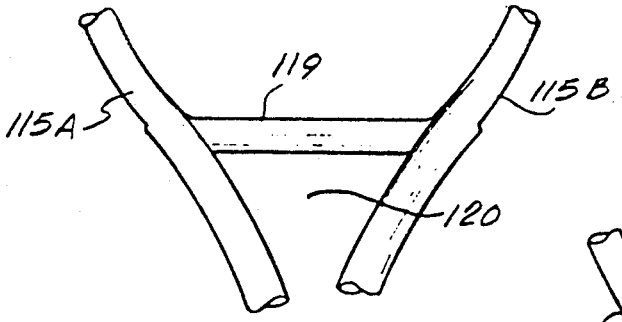
Figure 9:
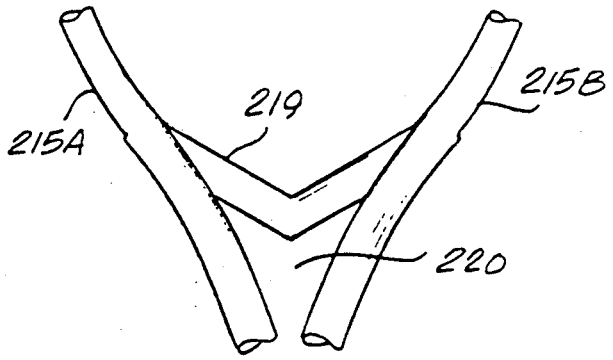
Figure 10:
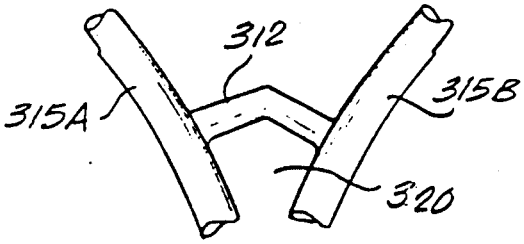

It is to be understood that the bridge can be of other shapes than as illustrated in FIG. 1. For instance, the bridge might extend straight across the throat as shown in FIG. 8 (bridge 119), be "Vee"-shaped as shown in FIG. 9 (bridge 219), reversed "Vee"-shaped as shown in FIG. 10 (bridge 312), or not used at all. If utilized, preferably the bridge 119, 219 or 312 is hollow and of circular or essentially circular cross section, as is the bridge 19 shown in FIG. 1. The diameter of the bridge 119, 219 and 312 will vary to meet the needs of the racket, but likely will be of the range of the diameter of bridge 19 discussed above.

The head 17 is formed in an elongated, elliptical shape. However, the head could be formed in other shapes without departing from the spirit or scope of the present invention. Also, preferably, the head 17 is composed of resin-impregnated graphite fibers or other high-strength, low weight fiber materials. The head 17 preferably is hollow and has a circular or substantially circular cross section. Further, head 17 cooperates with the bridge 19 to form a closed elliptical shape. As more fully described below, the head 17 has a circular or substantially circular cross section which may be of variable diameters. It can be appreciated that like the racket frames of the prior art, the head, throat, bridge and handle of the present invention are all substantially coplanar.

Although in the preferred embodiment described above, the elements (with the exception of handle 13) are composed of graphite fibers, it can be appreciated that the material used to construct the above components may be varied. For example, various composites of graphite, ceramic, Kevlar®, boron, aluminum and other metals may be used to form the elements. Further, although the racket elements may be hollow, in an alternative embodiment, the hollow cores of the head 17, throat portions 15A and 15B, and the bridge 19 are filled with an expanded foam plastic material of various compositions.

The wall thickness of the various elements of the racket frame may be varied depending on the particular diameter of the element, the desired stiffness thereof, and the material from which the element is constructed. For instance, if the racket elements are constructed from graphite, preferably the wall thickness of the elements may vary from about .20 millimeters to 5.0 millimeters and ideally from about .40 millimeters to 3.0 millimeters. As a result, the racket frame may weigh from about 150 to 350 grams.

As noted above, the head 17 and the bridge 19 cooperatively define a closed and substantially elliptical shape which is termed the stringing area 21. The stringing area 21 contains strings for striking a ball. The stringing area 21 is dependent upon the size and shape of head 17 and bridge 19. The stringing area 21 is preferably from 85 square inches to 109 square inches, and perhaps even larger. In one preferred embodiment of the present invention, the stringing area 21 is approximately 97 square inches.

The strings occupying the stringing area 21 are secured to the frame by means of holes in the racket frame. The holes (not shown for clarity) extend through the racket frame and allow the strings to traverse through the frame. Such holes are formed in both the head portion 17 and bridge 19 of the racket frame of the present invention. Also, along the outer periphery of the head 17 is a shallow stringing groove 29. This groove 29 allows strings which are secured to the head 17 to lie within the groove 29 such that the strings will not be damaged if the head 17 scrapes the ground during use. As seen in FIGS. 3, 4 and 5, although the groove 29 is an indentation in an otherwise circular cross section, the overall change to the circular cross section is negligible.

Still referring to FIG. 1, the head portion 17 is further comprised of lower sections 23A and 23B, middle sections 25A and 25B, and a crown section 27. It is to be understood that the crown section 27, middle sections 25A and 25B, and lower sections 23A and 23B are not distinct elements, but rather differing sections of the head portion 17 which is of singular and unitary construction. As seen in the cross-sectional view of FIG. 2, in one preferred embodiment of the present invention, the lower sections 23A and 23B have a diameter of about 21.8 millimeters middle sections 25A and 25B have a diameter of about 18.0 millimeters, and the crown section 27 has a diameter of about 21 millimeters at the very top of the head portion 17. Although the diameters of the sections comprising the head 17 differ, it can be appreciated that the transition from the lower sections, middle sections and crown section is continuous, with the head 17 maintaining a circular cross section throughout. Further, although the diameter measurements for the preferred embodiment are given above, it can be appreciated that the diameter measurements are for the particular cross sections along the lines 3—3, 4—4 and 5—5 shown in FIG. 1 and that measurements taken in the transitional areas between these cross-sectional locations will be different.

As seen in FIG. 2, the tennis racket 11, as viewed in the plane of the stringing area 21, has a "thick-thin-thick" profile. The middle sections 25A and 25B of head 17 generally have a thinner diameter than the crown section 27, lower sections 23A and 23B and throat portions 15A and 15B. This configuration allows the racket to have sufficient stiffness in the crown and throat portions for control while reducing stiffness in the ball-striking area of the middle portions 25A and 25B. Specifically, because the middle portions 25A and 25B of the head is thinner than the throat and the crown portions, the middle sections flex more when striking a ball which reduces the level of vibration generated. In addition, the stiffness arising from the increased thickness in the throat and crown portions allow for an increase in power and control.

Applicant has determined that the stiffness of the tennis racket 11 with a stringing area 21 of about 97 square inches is approximately RA 72. Of course other stiffness may be achieved by varying the cross-sectional diameters of the various elements of the racket frame, the wall thickness of the various elements as well as the material composition of the various elements.

In an alternative preferred embodiment of the present invention shown in FIG. 6, all of the sections which comprise head 17' have substantially the same cross-sectional diameter. The components of the racket frame 11' shown in FIG. 6 that are comparable to the components of the racket frame 11 shown in FIGS. 1-5 are referred to by the same part number but with a prime (') designation. The cross-sectional diameter of these sections in this embodiment ideally are between about 15 to 25 millimeters, but can be smaller or larger than this range. Further, preferably the circular cross section of the tennis racket is constant through the head portion 17 and throat portions 15A and 15B.

Figure 7:
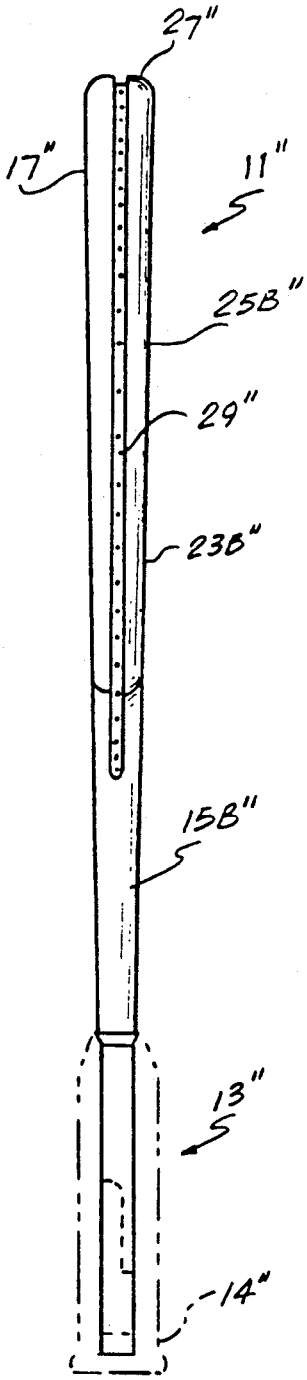

In an additional preferred embodiment of the present invention illustrated in FIG. 7. The components of the racket frame 11" shown in FIG. 7 that are comparable to the components of the racket frame 11 shown in FIGS.1-5 are given the same part number but with a double prime (") designation. As shown in FIG. 7, the crown section 27" has a diameter of about 35 to 25 millimeters, the middle sections 25A" and 25B" have a diameter of about 30 to 20 millimeters and the lower sections 23A and 23B have a diameter of about 25 to 15 millimeters. Thus, it can be seen that the tennis racket shown in FIG. 7, as viewed parallel to the plane of the stringing area 21", has a thickness which constantly decreases from the crown section 27" through the middle sections 25A" and 25B", the lower sections 23A" and 23B", and the throat portions 15A" and 15B".

With all of the embodiments described above, because of the circular cross section of the portions comprising the frame, enhanced aerodynamic response is provided. A racket frame having a circular cross section provides less aerodynamic drag than rackets constructed in other cross-sectional shapes. As noted above, although some shapes may have a lower aerodynamic drag in certain racket movements and orientations, for the large variety of racket strokes, the circular cross section provides the most efficient overall aerodynamic performance.

The increased efficiency created by reducing aerodynamic drag can be significant. For example, the average tennis player swings the racket on the order of 40 miles per hour (mph), whereas the top players can generate a racket head speeds approaching 100 mph. Thus, it can be appreciated that any increase in the aerodynamic profile of a tennis racket will significantly reduce energy expenditure in a tennis stroke.

While the preferred embodiments of the invention have been illustrated and described, it will be appreciated that various changes can be made therein without departing from the spirit and scope of the invention. Thus, within the scope of the appended claims, it is to be understood that the invention can be practiced otherwise than as specifically described herein.

I claim:

1. A racket frame comprising:

an elongated handle portion;

a throat portion comprised of a left and a right segment each of substantially circular cross section, said segments having first ends extending longitudinally and laterally and outwardly from a first end of said handle;

a bridge portion having a substantially circular cross section, said bridge portion extending transversely to the length of the handle and intersecting the left and right segments of said throat opposite the handle; and an arcuate head portion cooperating with the bridge portion to form a closed curvilinear shape, the head portion comprised of a lower section adjacent the bridge portion, a middle section next adjacent the lower section, and a crown section opposite the bridge portion, said lower, middle, and crown sections having substantially circular cross sections, wherein each of said throat portion, said lower section, said middle section, and said crown section has a stiffness level and at least two of said stiffness levels differ.

2. The racket frame of claim 1, wherein the left and right segments of the throat portion are arcuate along the lengths thereof to curve laterally outwardly from the first end of the handle to tangentially intersect the head portion.

3. The racket frame of claim 1, wherein the bridge portion is arcuate and complimentary to the cross section of the head portion.

4. The racket frame of claim 1, wherein the bridge portion is substantially straight along its length.

5. The racket frame of claim 1, wherein the head portion and the bridge portion defines an elliptical shape, defining a stringing area of from about 85 to 109 square inches.

6. The racket frame of claim 1, wherein said lower section of the head portion has a first cross section diameter, said middle section of the head portion has a second cross section diameter, and said crown section of the head portion has a third cross section diameter, said first, second, and third cross section diameters are substantially of equal lengths.

7. The racket frame of claim 6, wherein the first diameter, the second diameter, and the third diameter range from about 15 to 25 millimeters.

8. The racket frame of claim 7, wherein the cross-sectional diameter of the throat portion is from about 19 to 25 millimeters.

9. The racket frame of claim 1, wherein the throat portion, bridge portion and head portion are all of tubular construction and have a wall thickness in the preferred range of from 0.2 millimeters to 5.00 millimeters.

10. The racket frame of claim 9, wherein the throat portion, bridge portion and head portion have a wall thickness ideally from 0.4 millimeters to 3.0 millimeters.

11. A racket frame comprising:

an elongated handle portion;

a throat portion comprised of a left and a right segment each of substantially circular cross section, said segments having first ends extending longitudinally and laterally and outwardly from a first end of said handle;

a bridge portion having a substantially circular cross section, said bridge portion extending transversely to the length of the handle and intersecting the left and right segments of said throat opposite the handle; and an arcuate head portion cooperating with the bridge portion to form a closed curvilinear shape, the head portion comprised of a lower section adjacent the bridge portion, a middle section next adjacent the lower section, and a crown section opposite the bridge portion, said lower, middle, and crown sections having substantially circular cross sections, wherein said lower section has a first cross section diameter, said middle section has a second cross section diameter, and said crown section has a third cross section diameter, and wherein said first and third cross section diameters are greater than said second cross section diameter.

12. The racket frame of claim 11, wherein the first and third cross section diameter are substantially equal.

13. The racket frame of claim 11, wherein said first, second, and third cross section diameter of the head portion are all greater than the cross section diameter of said bridge portion.

14. A racket frame comprising:

an elongated handle portion;

a throat portion comprised of a left and a right segment each of substantially circular cross section, said segments having first ends extending longitudinally and laterally and outwardly from a first end of said handle;

a bridge portion having a substantially circular cross section, said bridge portion extending transversely to the length of the handle and intersecting the left and right segments of said throat opposite the handle; and an arcuate head portion cooperating with the bridge portion to form a closed curvilinear shape, the head portion comprised of a lower section adjacent the bridge portion, a middle section next adjacent the lower section, and a crown section opposite the bridge portion, said lower, middle, and crown sections having substantially circular cross sections, wherein said lower section has a first cross section diameter, said middle section has a second cross section diameter, and said crown section has a third cross section diameter, and wherein said third cross section diameter is greater than said second cross section diameter, said second cross section diameter is greater than said first cross section diameter, and said first cross section diameter is greater than the cross section diameter of said bridge portion.

15. A racket frame comprising:

an elongated handle portion;

a throat portion comprised of a left and a right segment each of substantially circular cross section, said segments having first ends extending longitudinally and laterally and outwardly from a first end of said handle;

a bridge portion having a substantially circular cross section, said bridge portion extending transversely to the length of the handle and intersecting the left and right segments of said throat opposite the handle; and an arcuate head portion cooperating with the bridge portion to form a closed curvilinear shape, the head portion comprised of a lower section adjacent the bridge portion, a middle section next adjacent the lower section, and a crown section opposite the bridge portion, said lower, middle, and crown sections having substantially circular cross sections, wherein each of said throat portion, said lower section, said middle section, and said crown section has a diameter and at least two of said diameters differ.

* * * * *